US011835214B1

(12) United States Patent
Jiang

(10) Patent No.: US 11,835,214 B1
(45) Date of Patent: Dec. 5, 2023

(54) WATERPROOF LIGHT HEAD STRUCTURE OF STAGE LIGHT FIXTURE, AND STAGE LIGHT FIXTURE WITH SAME

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 18/175,879

(22) Filed: Feb. 28, 2023

(30) Foreign Application Priority Data

Dec. 30, 2022 (CN) ..... 202223609970.0

(51) Int. Cl.
*F21V 31/00* (2006.01)
*F21V 21/30* (2006.01)
*F21W 131/406* (2006.01)

(52) U.S. Cl.
CPC ..... *F21V 31/005* (2013.01); *F21V 21/30* (2013.01); *F21W 2131/406* (2013.01)

(58) Field of Classification Search
CPC . F21V 21/30; F21V 31/005; F21W 2131/406; F21W 2131/105; G03B 21/20; G03B 21/105
See application file for complete search history.

(56) References Cited

U.S. PATENT DOCUMENTS

2019/0137090 A1* 5/2019 Jiang ..... F21V 15/01
2021/0071849 A1* 3/2021 Li ..... F21V 15/01
2021/0131657 A1* 5/2021 Jiang ..... F21V 21/30

FOREIGN PATENT DOCUMENTS

WO WO-2020037978 A1 * 2/2020 ..... F21S 8/00

OTHER PUBLICATIONS

Machine translation of Jiang, WO 2020/037978, published Feb. 27, 2020 (Year: 2020).*

* cited by examiner

*Primary Examiner* — William N Harris
(74) *Attorney, Agent, or Firm* — Muncy, Geissler, Olds & Lowe, P.C.

(57) ABSTRACT

A waterproof light head structure of a stage light fixture includes a main bracket, a front cover and a rear cover respectively disposed at the front side and the rear side of the main bracket, and a light outgoing lens assembly disposed above the main bracket. The main bracket includes an upper support and a lower support, the upper support is mounted above the lower support and is in sealed and detachable connection with the lower support. The upper support is at least used for mounting an optical lens assembly, and the lower support is at least used for mounting an effect assembly. The main bracket is disposed in a cavity formed by joining the front cover with the rear cover, and the front cover and the rear cover are in sealed connection with the light outgoing lens assembly and the main bracket along the edges thereof.

12 Claims, 8 Drawing Sheets

WATERPROOF LIGHT HEAD STRUCTURE OF STAGE LIGHT FIXTURE, AND STAGE LIGHT FIXTURE WITH SAME

CROSS REFERENCE TO RELATED APPLICATIONS

The present application claims priorities from Chinese Application No. 202223609970.0 filed on Dec. 30, 2022, all of which are hereby incorporated herein by reference.

TECHNICAL FIELD

The present invention relates to technical field of stage light fixtures, and more particularly, relates to a waterproof light head structure of a stage light fixture, and a stage light fixture with the same.

BACKGROUND

Stage light fixtures are often used to render atmosphere on the stage with colorful and changeable colors. Because of characteristics of real-time positioning, flexible steering and controllable color mixing, the stage light fixtures are widely used, such as in parties, concerts, outdoor performances, urban lighting projects, entertainment places, building decoration and other relevant fields. Therefore, in order to demand the wide use in various occasions, especially in the outdoor or relatively wet places, the stage light fixture needs to have waterproof performance for normal and long-term use.

Existing waterproof light head of the stage light fixture commonly has structures that, as shown in FIG. 1, side plates of a light head bracket on both sides, especially the left and right sides, of the light head bracket serve as a part of a housing of the light head, and a front cover and a rear cover of the light head and the side plates of the light head bracket are spliced into the complete housing. Such light head structure although has waterproof performance, there are nonetheless obvious inconvenience during mounting and maintaining. Specifically, the inner structure support of the light head is formed by the left and right side plates of the light head bracket, in which diverse components are sequentially mounted. Illustration is especially shown with an optical lens assembly mounted on the right side plate of the light head bracket as an example. When the optical lens assembly is required to mount on the right side plate of the light head bracket, once the internal structure of the light head is basically formed the optical lens assembly can be mounted on the right side plate of the light head bracket, while it cannot be carried out simultaneously with mounting of other elements, such as an effect assembly, thus seriously affecting processing efficiency. Similarly, there are also same problems during maintaining. Moreover, during debugging, it is necessary to perform debugging by taking the whole light head as a unit. For example, when debugging the centering degree of optical lenses, it is needed to move the whole light head or the whole stage light fixture, the mounting and debugging process is accordingly quite inconvenient.

Therefore, there is an urgent need for a novel and improved waterproof light head structure of a stage light fixture to overcome deficiencies of known waterproof light heads.

SUMMARY

The present invention thus provides an improved waterproof light head structure of a stage light fixture, which can be waterproof efficiently as well as convenient to mount and maintain.

The light head structure according to the present invention includes a main bracket, a front cover and a rear cover respectively disposed at the front side and the rear side of the main bracket, a light outgoing lens assembly disposed above the main bracket, and a light source disposed in the main bracket. The main bracket has an upper support and a lower support, the upper support being mounted above the lower support, and the upper support being in sealed and detachable connection with the lower support. The upper support is at least used for mounting an optical lens assembly and the lower support is at least used for mounting an effect assembly. The main bracket is disposed in a cavity formed by joining the front cover with the rear cover, and each of the front cover and the rear cover is in sealed connection with the light outgoing lens assembly and the main bracket along the edges thereof to form an all-around waterproof structure.

Unlike the prior art, in which the two sides of the main bracket serving as side edges of the housing of the light head, in the present invention, the main bracket is provided in the cavity formed by joining the front cover with the rear cover, and waterproof performance is ensured in a way that the front cover and the rear cover are in sealed connection with the light outgoing lens assembly and the main bracket along the edges thereof. Compared to the conventional light head structures in which side plates of the light head bracket serve as a part of the housing, the present invention combines both the waterproof performance and the performance of easy to mount and maintain with changes of modularizing waterproof structure and mounting structure of internal assemblies.

Specifically, the main bracket is divided into the upper support for mounting the optical lens assembly and the lower support for mounting the effect assembly, which thus forms modularized design of partial structure for mounting the optical lens assembly and partial structure for mounting the effect assembly. The optical lens assembly and the effect assembly are two assemblies mainly mounted in the stage light fixture, and the mounting process of the two assemblies is also the most time-consuming. However, by means of modularization in the present invention, each mounting process of the two assemblies mainly mounted in the stage light fixture and the corresponding supporting structure thereof are relatively independent from each other. That is, the mounting of the optical lens assembly on the upper support and the mounting of the effect assembly on the lower support can be conducted at the same time. The upper support and the lower support then joined to form the complete main bracket with the optical lens assembly and the effect assembly mounted thereon, which thus significantly improving convenience and mounting efficiency.

In addition to visually improving convenience in the mounting process, the convenience in the actual processing and production/use process thereof is also significantly improved. Taking debugging the centering degree of an optical lens as an example, in the traditional light head structure, all the components are usually mounted on the two side plates of the light head bracket serving as side edge housings, the internal structure of a light head is thus relatively compact, the position and space are fixed and limited, usually, and the components can only be mounted in sequence, resulting in low efficiency. Such defects also have obvious impact on the debugging process, as the optical lens assembly is usually the element in the internal assembly to be finally mounted. Therefore, in order to debugging the centering degree of the optical lens assembly, the entire light head is taken as a debugging unit and is frequently moved to determine the centering degree. However, the present invention, due to the modularized design, the corresponding mounting processes of the upper and lower supports are relatively independent, thereby not only facilitating efficient processing, but also improving convenience of debugging. According to the present invention, when mounting the optical lens on the upper support, only the upper support is required to be moved, which significantly saves effort and is more convenient compared to moving the entire light head.

According to the present invention, each of the left and right sides of the main bracket is provided with a main side plate. Each of the left and right sides of the upper support is provided with a first side plate, and each of the left and right sides of the lower support is provided with a second side plate, the main side plate may be formed by the first side plate and the second side plate.

The optical lens assembly may include at least one of a light outgoing lens assembly, a focusing lens assembly, a magnifying lens assembly, a prism and a frosting lens. The effect assembly may include at least one of a CMY assembly, a cutter assembly, a gobo assembly, and a color wheel assembly.

According to the present invention, the upper support includes a first mounting support and first side plates respectively disposed at the left and right sides of the first mounting support, and each first side plate is in sealed connection with the lower support. The optical lens assembly is mounted on the first mounting support. Specifically, each first side plate is in sealed connection with the lower support via a first side plate waterproof strip, and a first side plate waterproof strip groove for correspondingly mounting the first side plate waterproof strip is provided at the bottom end of the side plate or the upper end of the lower support. In order to ensure the waterproof performance of the side edges of the main bracket itself, the side plates are in sealed connection with the lower support, thus achieving the waterproof performance of the side edges of the main bracket at the joint of the upper and lower supports. In such configuration, the relative independence of the first mounting support and the first side plates thus ensures that the assembly mounting process on the first mounting support is relatively independent from the waterproof process at the corresponding joint of the upper support and the lower support, which improves the mounting convenience and maintainability. For example, after completion of mounting the assembly on the first mounting support and debugging thereof, only the first side plates need to be fixed at the two sides of the first mounting support to achieve waterproof performance, operation thus is more convenient according to the present invention.

The upper end of the first side plate is in sealed connection with the left and right sides of the light outgoing lens assembly via cooperation therebetween. Specifically, the upper end of each first side plate extends inwardly to form a U-shaped opening, and the U-shaped openings of the first side plates at the left and right sides are engaged with the both sides of the light outgoing lens assembly to form sealed connection. Therefore, with the configuration of the U-shaped opening at the upper end of the respective first side plate, it is thus convenient to engage with the light outgoing lens assembly to achieve sealing of the left and right sides thereof, facilitating that an integral sealed waterproof structure can be completed only with sealed connection between the front cover and the rear cover and the front and rear edges of the light outgoing lens assembly and the main bracket. Preferably, the upper end of each first side plate is in sealed connection with the light outgoing lens assembly via a U-shaped light outgoing lens assembly waterproof strip, and a light outgoing lens assembly waterproof strip groove for mounting the light outgoing lens assembly waterproof strip is provided at one side of the light outgoing lens assembly corresponding to the first side plate or at the inner side of the U-shaped opening of the first side plate. A limiting protrusion can be further formed on the light outgoing lens assembly waterproof strip. The limiting protrusion can be formed on the upper surface and/or the lower surface of the light outgoing lens assembly waterproof strip. The light outgoing lens assembly waterproof strip groove is matched with the light outgoing lens assembly waterproof strip in shape.

According to the present invention, the first mounting support can include a transversal beam and vertical plates respectively at the left and right sides of the transversal beam. The vertical plate is disposed at the inner side of the respective first side plate. The inner side of at least one vertical plate is provided with a sliding rail for guiding the movement of the optical lens assembly, and/or the outer side of at least one vertical plate is provided with a drive circuit board. In the prior art, elements are basically fixed to the inner sides of the left and right side plates of the light head bracket, which thus will be obstructed by the left and right side plates of the light head bracket when maintaining the element interior. For example, an optical lens drive circuit may be obstructed by the right side plate, causing difficulty on maintenance. In addition to independence between mounting of the assembly and waterproof way of the main bracket, the vertical plate of the first mounting support also facilitates arrangement of the circuit board including the drive circuit. Since the first side plate is detachable, only the first side plate is required to be removed to observe the maintenance region during maintaining the circuit board.

In the present invention, the light outgoing lens assembly can include a lens module and a flange. The lens module is fixedly mounted at the upper end of the upper support by the flange, and the flange is in sealed connection with the upper end of the upper support. Especially, the lens module is fixedly mounted at the upper end of the vertical plate of the upper support by the flange, and the flange is in sealed connection with the upper end of the vertical plate. In order to achieve mounting, the upper end of the vertical plate is provided with at least one mounting hole, the flange is fixed to the vertical plate by a fixing member matched with the mounting hole, and the fixing member is in sealed connection with the respective mounting hole via a corresponding fixing member waterproof ring below the flange. The fixing member may be screws. The light outgoing lens assembly may further include a lens ring sleeved with the lens module. Especially, the U-shaped opening at the upper end of the first side plate is in sealed connection with the left and right sides of the flange.

The lower support comprises a second mounting support and a light source base, the second mounting support is mounted above the light source base, and the second mounting support is in sealed connection with the light source base. The effect assembly is mounted in the second mounting support. In the present invention, the lower support is further modularized to make the mounting of the light source and the effect assembly relatively independent, thereby facilitating mounting and maintaining thereof. Specifically, the second mounting support is in sealed connection with the light source base via a second mounting support waterproof strip, and a second mounting support waterproof strip groove for correspondingly mounting the second mounting support waterproof strip is provided at the lower end of the second mounting support or at the upper end of the light source base. The second mounting support can include a second side plate at each side thereof, and the upper end of the second side plate extends inwardly to form a flat mounting plate. The upper support is in sealed connection with the flat mounting plate. Especially, the bottom end of the first side plate is in sealed connection with the flat mounting plate. The first side plate waterproof strip groove can be disposed at the bottom end of the side plate or the upper surface of the flat mounting plate. The light source base can include a light source and a heat dissipation assembly, and the light source is mounted on the upper surface of the heat dissipation assembly in a sealed way.

According to the present invention, with the configuration of the first side plates on the left and right sides of the upper support, the second side plates on the left and right sides of the second mounting support, and the second side plates being in sealed connection with the light source base, the front cover and the rear cover thus are in sealed connection with the light outgoing lens assembly, the first side plates, the second side plates, and the light source base. The lower end of the second side plate is in sealed connection with the upper end of the light source base.

In order to drive the whole light head to rotate, each left and right sides of the main bracket is provided with a pivot shaft in a sealed way, which pivot shaft is rotatably connected to an external U-shaped support. Further in a bid to facilitate passing wires of elements between the U-shaped support and the interior of the light head structure, each of the left and right sides of the main bracket is provided with a wire-passing hole, the position of the pivot shaft corresponding to the wire-passing hole is in sealed connection with the main bracket. Specifically, the pivot shaft is in sealed connection with the main bracket through a pivot shaft waterproof strip. The pivot shaft waterproof strip is preferably in ring shape, and the size thereof is greater than that of the wire-passing hole, which pivot shaft waterproof strip is located between the outer edge of the pivot shaft and the wire-passing hole. Correspondingly, each of the front cover and the rear cover is provided with an arc-shaped groove corresponding to the respective pivot shaft, so that when the front cover and the rear cover are joined, the arc-shaped grooves of the front cover and the rear cover are engaged to form an avoidance hole for the respective pivot shaft. Especially, the pivot shafts are respectively mounted at the two sides of the second mounting support, the wire-passing holes are arranged in the left and right sides of the second mounting support. The pivot shaft is correspondingly provided with a through hole for passing through wires.

In the present invention, the front cover and the rear cover are of a groove-shaped structure, in which a main body waterproof strip groove matched with the outer edges of the front and rear sides of the light outgoing lens assembly and the front and rear sides of the main bracket is provided.

An integrated main body waterproof strip in sealed connection with the outer edges of the front and rear sides of the light outgoing lens assembly and the front and rear sides of the main bracket is arranged in the main body waterproof strip groove, and the shape of the integrated main body waterproof strip is matched with the outer edges of the front and rear sides of a cavity structure formed by the light outgoing lens assembly and the main bracket.

In another aspect, a stage light fixture is further provided, which includes the above-mentioned waterproof light head structure. The stage light fixture including the waterproof light head structure according to the present invention can be easy to process, mount, maintain and use.

Accordingly, the waterproof light head structure of the present invention combines both waterproof feature and modularization feature of a non-waterproof light head structure, which can overcome the defects of inconvenience to mount and maintain existing in the prior art. According to the present invention, the waterproof performance is ensured, while the internal main mounting structure is modularized to improve mounting convenience. Therefore, mounting of the optical lens assembly and the effect assembly can be performed simultaneously, thus significantly improving mounting efficiency. In the other hand, the modularized structure can also enhance convenience of debugging and maintaining, which reduces the difficulty of debugging and maintaining. The stage light fixture with the same waterproof light head structure thus greatly simplify and facilitate the mounting, debugging, and maintaining work.

DETAILED DESCRIPTION

Figure 1:
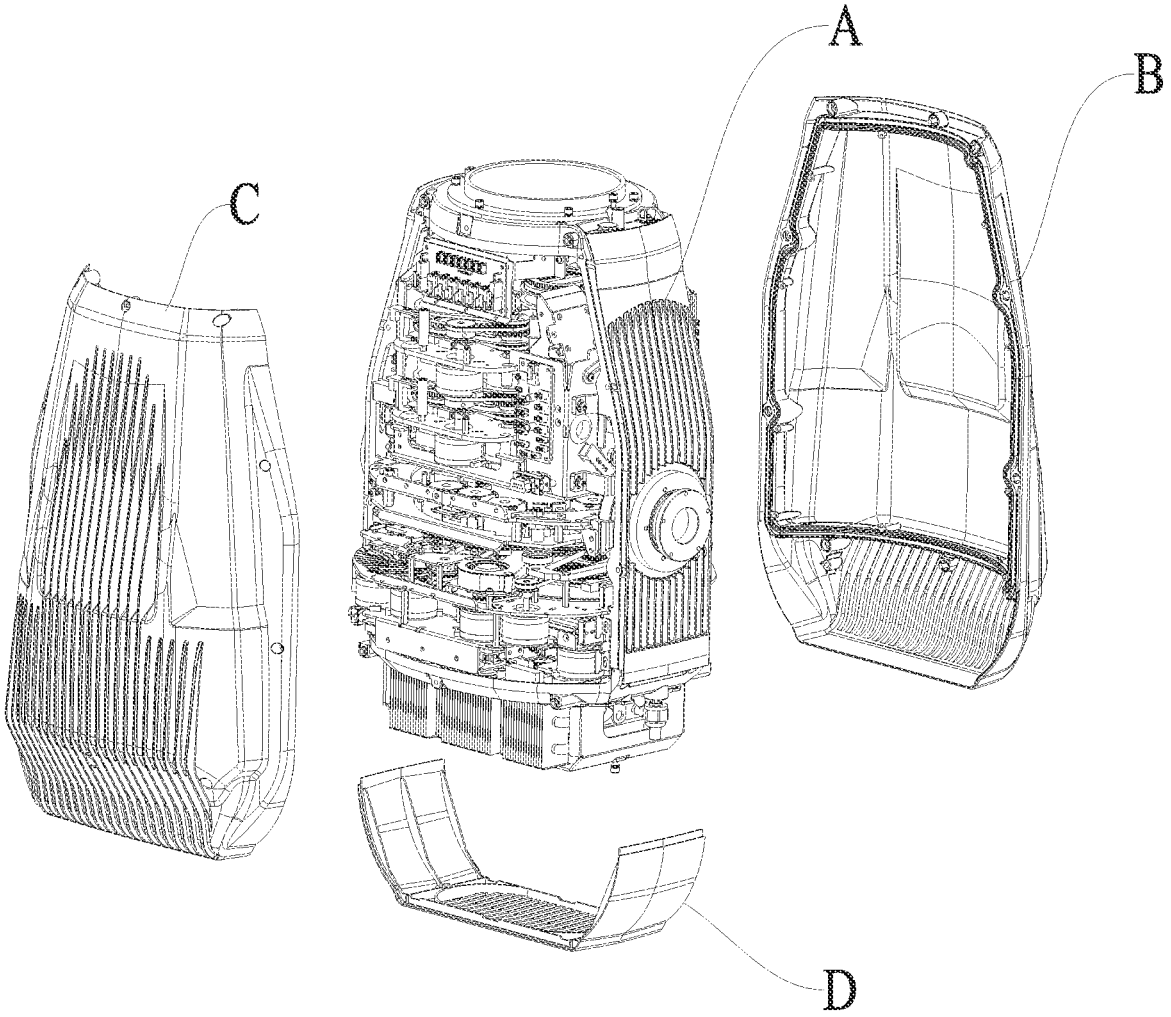
FIG. 1 PRIOR ART
FIG. 1 is a waterproof light head structure in the prior art.

The accompanying drawings are for exemplary illustration only, and should not be construed as limitations on the present invention. in order to better illustrate the following embodiment, some parts in the accompanying drawings may be omitted, enlarged or reduced, and they do not represent the size of the actual product; for those skilled in the art, it is understandable that certain well-known structures and descriptions thereof in the drawings may be omitted.

Figure 2:
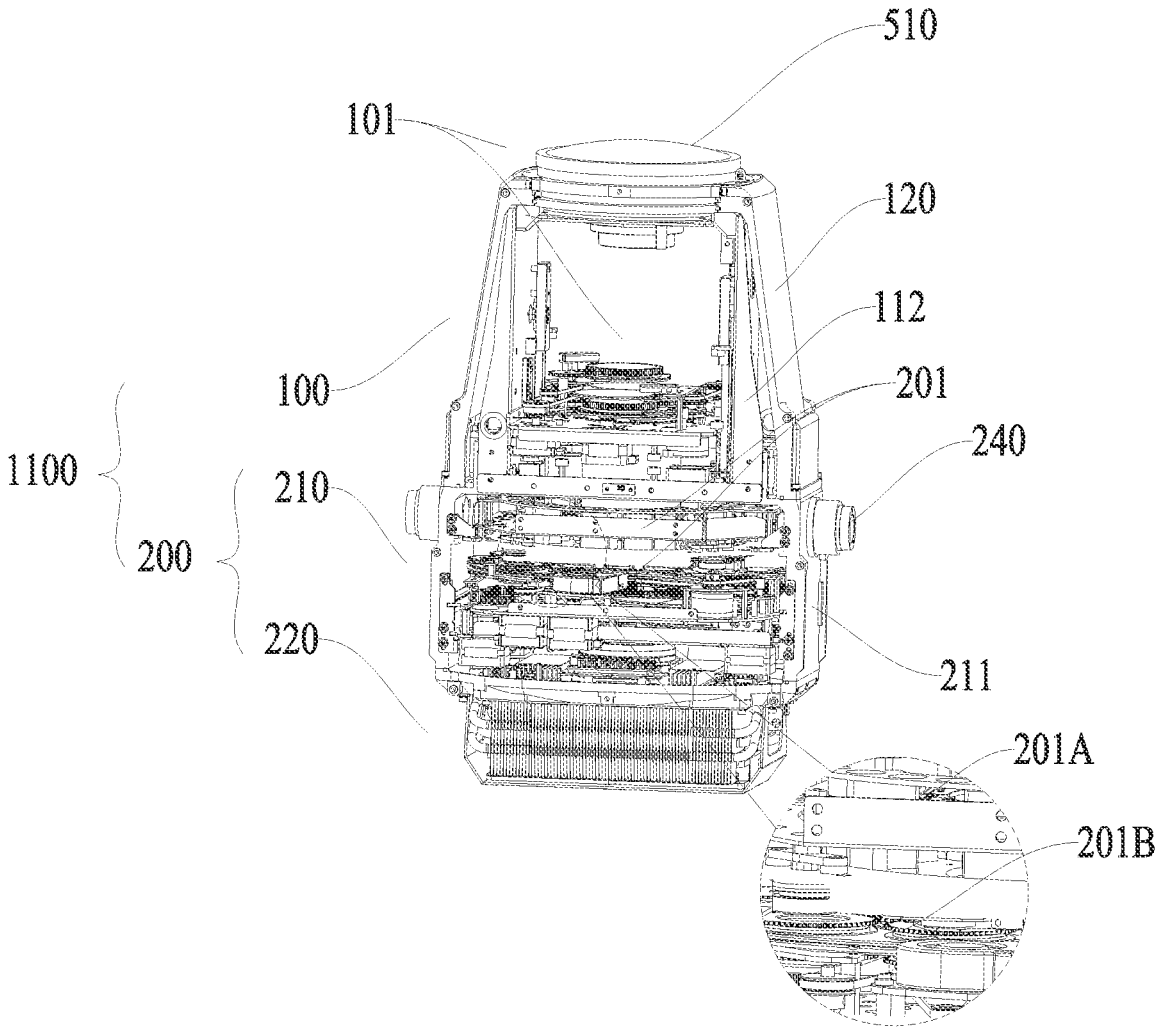
FIG. 2 is a structural schematic diagram of a main bracket and a lens module in the present invention.
Figure 3:
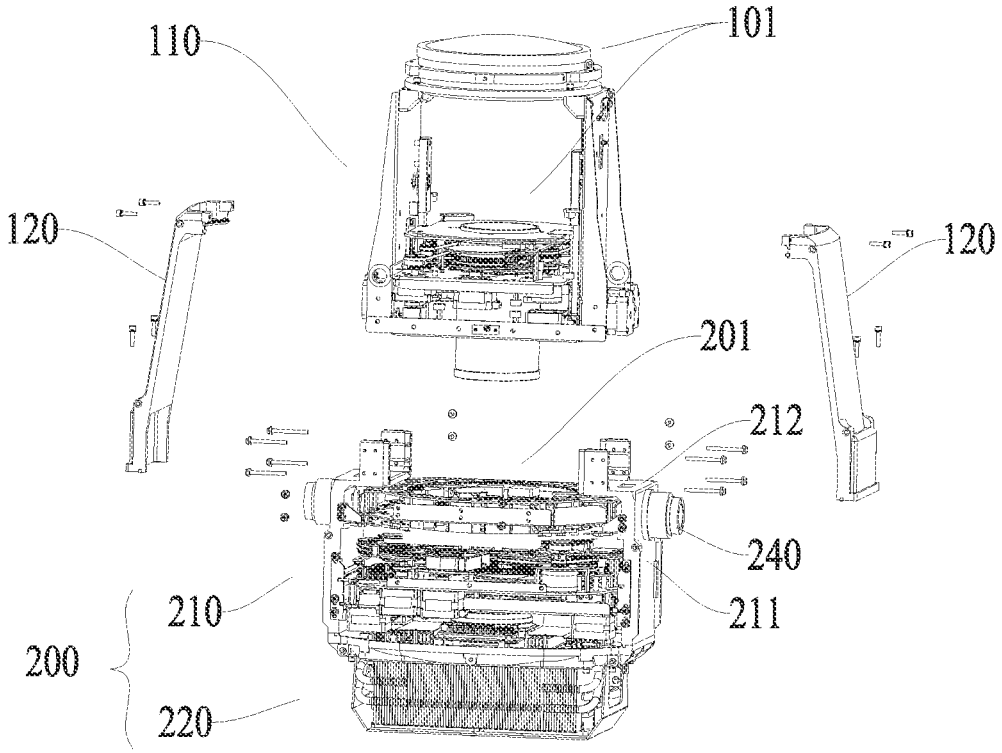
FIG. 3 is a structural schematic diagram of an upper support and a lower support in the present invention.
Figure 4:
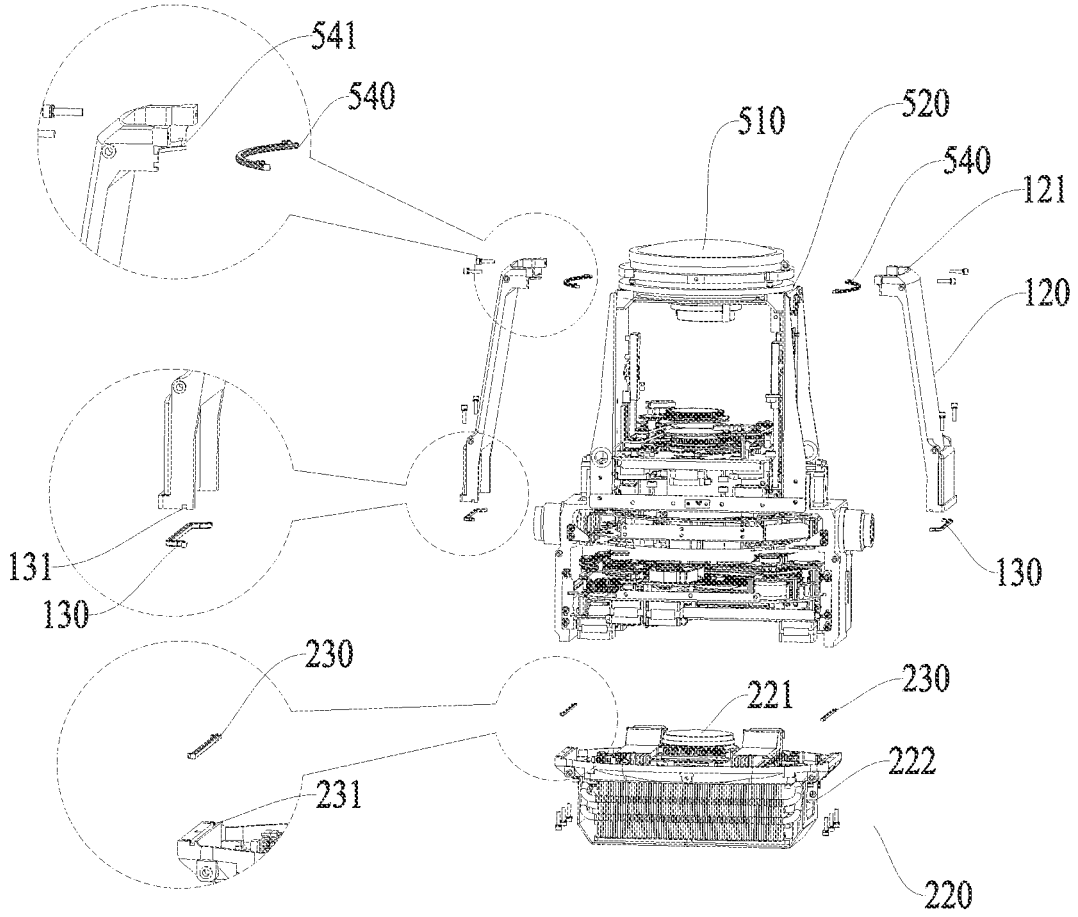
FIG. 4 is a structural schematic diagram of the upper support, a second mounting support, and a light source base in the present invention.
Figure 8:
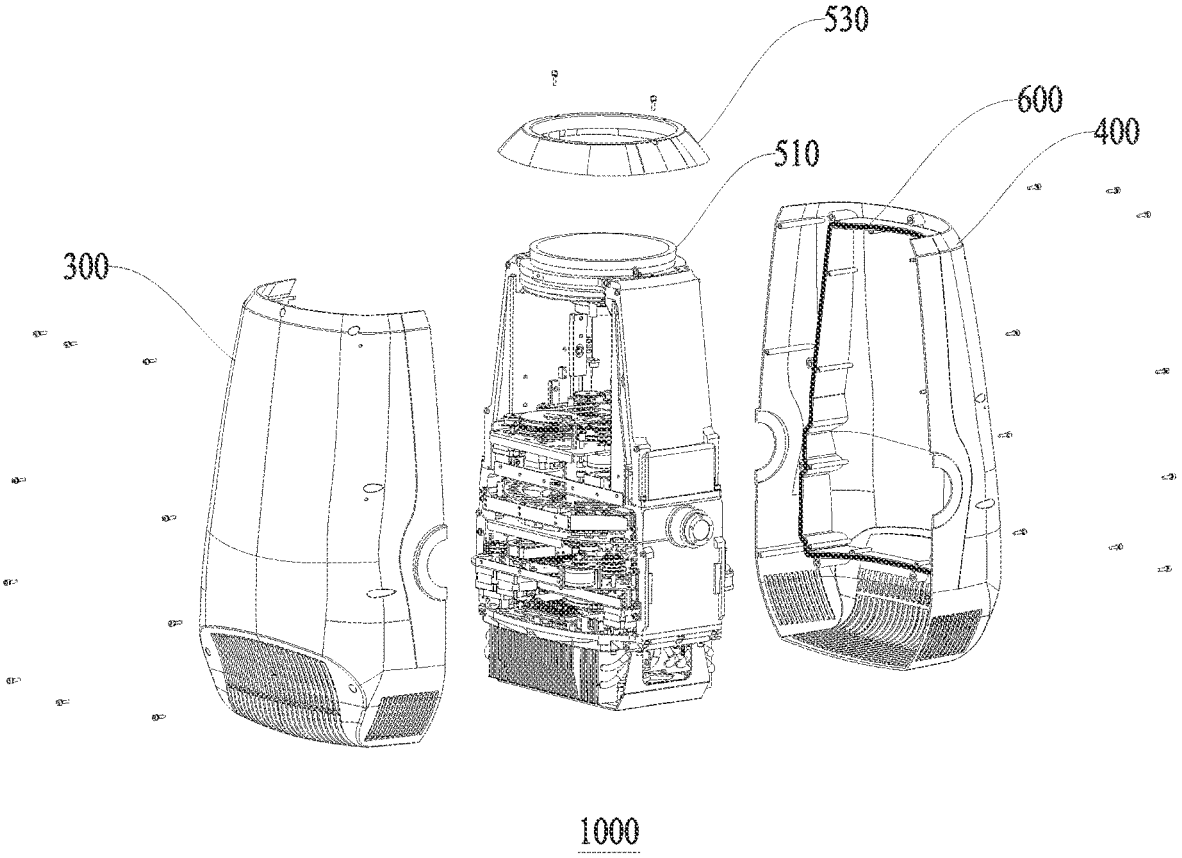
FIG. 8 is a schematic diagram with a front cover, the rear cover and an internal structure of a waterproof light head structure assembled in the present invention.

Referring to FIGS. 2-4, a waterproof light head structure 1000 of a stage light fixture is provided according to an embodiment, which includes a main bracket 1100, a front cover 300 and a rear cover 400 (shown in FIG. 8) respectively disposed on a front and rear side of the main bracket 1100, a light outgoing lens assembly 500 disposed above the main bracket 1100, a light source 221 disposed in the main bracket 1100, and a plurality of optical components disposed in the direction of a main optical axis of lighting emitted by the light source 221 and mounted on the main bracket 1100. In this embodiment, the optical component may include an optical lens assembly 101 and an effect assembly 201. The main bracket 1100 includes an upper support 100 and a lower support 200 which is in sealed and detachable connection therewith, the upper support 100 being mounted above the lower support 200. The upper support 100 is at least used for mounting the optical lens assembly 101, while the lower support 200 is at least used for mounting the effect assembly 201. The light emitted by the light source 221 is emitted out by sequentially passing through the effect assembly 201, the optical lens assembly 101 and the light outgoing lens assembly 500. As shown in FIG. 8, the front cover 300 and the rear cover 400 can be joined to form a cavity, and the main bracket 1100 is provided in the cavity. The front cover 300 and the rear cover 400 are in sealed connection with the light outgoing lens assembly 500 and the main bracket 1100 along the edges thereof to form an all-around waterproof structure. The front cover 300 and the rear cover can be fixedly connected, such as through screws.

FIG. 1 shown a waterproof light head structure in the prior art. In such configuration, the waterproof light head structure is formed by encircled side plates A of a waterproof light head bracket of the light head, a front cover B, a rear cover C, and a bottom cover D. The side plates A of the light head bracket thus serve as a part of a housing of the light head, and different assemblies are directly mounted on the side plates A of the light head bracket.

Figure 9:
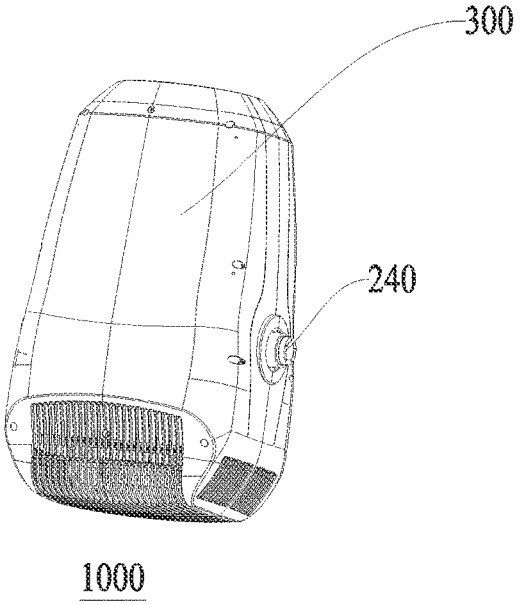
FIG. 9 is an overall assembly diagram of the waterproof light head structure in the present invention.

Dissimilar to the prior art, in which the two sides of the light head bracket serve as side edges of the housing, in the present invention, the main bracket 1100 is provided in the cavity formed by joining the front cover 300 with the rear cover 400, and waterproof performance is ensured in a way that the front cover 300 and the rear cover 400 are in sealed connection with the light outgoing lens assembly 500 and the main bracket 1100 along the edges thereof, especially shown in FIG. 8 and FIG. 9. Compared to the conventional type of light head structures in which the side plates A of the light head bracket serve as a part of the housing, the light head structure of the present embodiment combines both waterproof performance and performance of easy to mount and maintain with changes of modularizing waterproof structure and mounting structure of internal assemblies.

As FIG. 3 shown, the main bracket 1100 is divided into the upper support 100 for mounting the optical lens assembly 101 and the lower support 200 for mounting the effect assembly 201, which forms a modularized design of partial structure for mounting the optical lens assembly 101 and partial structure for mounting the effect assembly 201. The optical lens assembly 101 and the effect assembly 201 are two assemblies mainly mounted in the stage light fixture, and the mounting process of the two assemblies is also the most time-consuming. By means of modularization in the present embodiment, each mounting of the two main assemblies to be mounted in the stage light fixture and the corresponding supporting structure thereof are relatively independent from each other. That is, the mounting of the optical lens assembly 101 on the upper support 100 and the mounting of the effect assembly 201 on the lower support 200 can be conducted simultaneously, the upper support 100 and the lower support 200 then joined to form the complete main bracket 1100 with the optical lens assembly 101 and the effect assembly 201 mounted thereon, which thus significantly improves convenience and mounting efficiency.

In addition to visually improving convenience in the mounting process, convenience in the actual processing and production/use process thereof is also significantly improved. Taking debugging the centering degree of an optical lens as an example, in the traditional light head structure, all the components are usually mounted on the two side plates A of the light head bracket serving as the side edge of the housing, the internal structure of the light head thus is relatively compact, the position and space are fixed and limited, usually, the components can only be mounted in sequence, resulting in low efficiency. Such defects also have obvious impact on the debugging process, as the optical lens assembly 101 is usually the element in the internal assembly to be finally mounted. Therefore, in order to debugging the centering degree, the entire light head is required to be taken as a debugging unit and to be frequently moved to determine the centering degree. However, in the present invention, due to the modularized design, the corresponding mounting processes of the upper and lower supports are relatively independent, thereby not only facilitating efficient processing, but also improving convenience of debugging. According to the present invention, when mounting the optical lens on the upper support 100, only the upper support 100 is required to be moved, which significantly saves effort and is more convenient compared to moving the entire light head.

Figure 5:
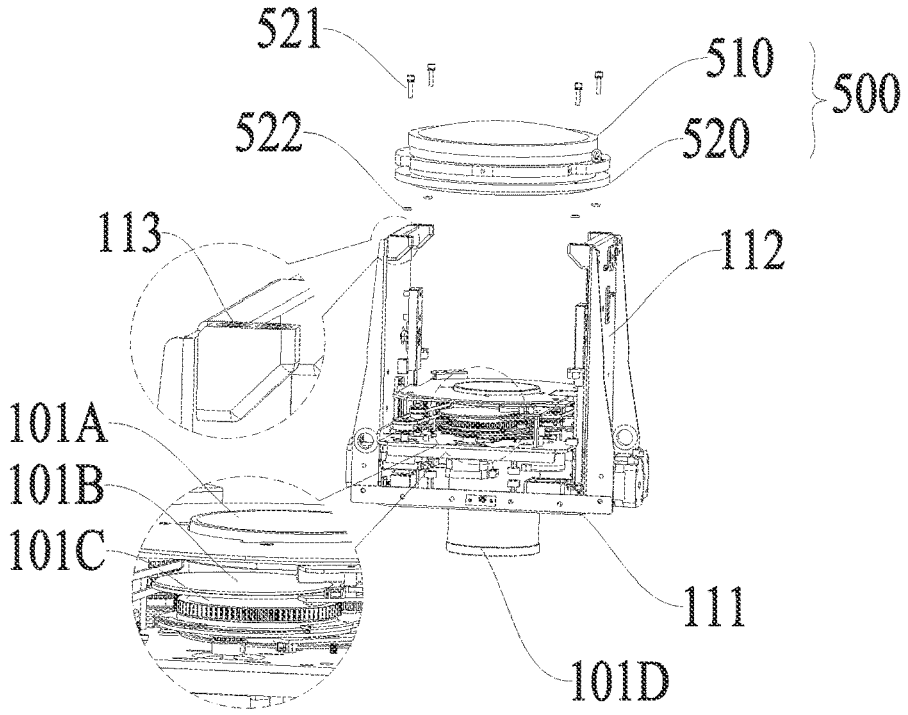
FIG. 5 is a structural schematic diagram of a first mounting support and a light outgoing lens assembly in the present invention.

In this embodiment, as shown in FIG. 2 and FIG. 5, the optical lens assembly 101 includes at least one of the light outgoing lens assembly 500, a focusing lens assembly 101D, a magnifying lens assembly 101A, a prism 101C and a frosting lens 101B. The effect assembly includes at least one of a CMY assembly (not shown in the figures), a shutter assembly 201A, a gobo assembly 201B, and a color wheel assembly (not shown in the figures).

Referring to FIGS. 3-4, in this embodiment, the upper support 100 includes a first mounting support 110 and first side plates 120 respectively provided at the left and right sides of the first mounting support 110, and each first side plate 120 is in sealed connection with the lower support 200. The optical lens assembly 101 is mounted in the first mounting support 110.

The first side plate 120 is in sealed connection with the lower support 200 via a first side plate waterproof strip 130. In this embodiment, the bottom end of the first side plate 120 is provided with a first side plate waterproof strip groove 131 for correspondingly mounting the first side plate waterproof strip 130. Besides, the first side plate waterproof strip groove 131 for correspondingly mounting the first side plate waterproof strip 130 may be provided at the upper end of the lower support 200. In this embodiment, both ends of the first side plate waterproof strip 130 is bent inwardly to form a limiting structure to prevent the waterproof strip from offsetting during use.

In this embodiment, the upper end of each first side plate 120 extends inwardly to form a U-shaped opening 121, and the U-shaped openings 121 of the respective first side plate 120 are engaged with the left and right sides of the light outgoing lens assembly 500 to form sealed connection. With the U-shaped opening 121 at the upper end of each first side plate 120, it is convenient to engage with the light outgoing lens assembly 500 to achieve sealing of the left and right sides thereof, so that an integral sealed waterproof structure can be completed by only sealing the front cover 300 and the rear cover 400 to the front and rear edges of the light outgoing lens assembly 500 and the main bracket 1100. Specifically, the upper end of the first side plate 120 is in sealed connection with the light outgoing lens assembly 500 by a U-shaped light outgoing lens assembly waterproof strip 540, and the inner side of each U-shaped opening 121 of the first side plate is provided with a light outgoing lens assembly waterproof strip groove 541 for mounting the light outgoing lens assembly waterproof strip 540. Besides, the light outgoing lens assembly waterproof strip groove 541 for mounting the light outgoing lens assembly waterproof strip 540 can be provided on the light outgoing lens assembly 500 corresponding to the first side plate 120.

A limiting protrusion is further formed on the light outgoing lens assembly waterproof strip 540. In this embodiment, the limiting protrusion is formed on the upper surface of the light outgoing lens assembly waterproof strip 540. The light outgoing lens assembly waterproof strip groove 541 is engaged with the light outgoing lens assembly waterproof strip 540 in shape.

Referring to FIG. 5, the first mounting support 110 includes a transversal beam 111 and vertical plates 112 at the left and right sides thereof. The vertical plate 112 is arranged at the inner side of the first side plate 120. The inner side of the vertical plate 112 is provided with a sliding rail for guiding movement of the optical lens assembly 101, and the outer side of the vertical plate 112 is provided with a drive circuit board.

In this embodiment, as shown in FIG. 5, the light outgoing lens assembly 500 includes a lens module 510 and a flange 520. The lens module 510 is fixedly mounted at the upper end of the upper support 100 via the flange 520, and the flange 520 is in sealed connection with the upper end of the upper support 100. Specifically, the lens module 510 is fixedly mounted at the upper end of the vertical plate 112 via the flange 520. The flange 520 is in sealed connection with the upper end of the vertical plate 112. In such way, the upper end of the vertical plate 112 is provided with at least one mounting hole 113, the flange 520 is fixed to the vertical plate 112 via a fixing member 521 matched with the mounting hole 113, and the fixing member 521 is hermetically fixed to the mounting hole 113 via a corresponding fixing member waterproof ring 522 below the flange 520. The fixing member 521 may be screws. The light outgoing lens assembly 500 further includes a lens ring 530 sleeved with the lens module 510 (see FIG. 8). In this embodiment, when the flange 520 is disposed, the U-shaped opening 121 formed at the upper end of the first side plate 120 is in sealed connection with the left and right sides of the flange 520.

As shown in FIGS. 3-4, the lower support 200 includes a second mounting support 210 and a light source base 220. The second mounting support 210 is mounted above the light source base 220, and the second mounting support 210 is in sealed connection with the light source base 220. The effect assembly 201 is mounted in the second mounting support 210. The second mounting support 210 is in sealed connection with the light source base 220 via a second mounting support waterproof strip 230, and the upper end of the light source base 220 is provided with a second mounting support waterproof strip groove 231 for correspondingly mounting the second mounting support waterproof strip 230. In addition, the second mounting support waterproof strip groove 231 can be provided at the lower end of the second mounting support 210. In this embodiment, a limiting protrusion is formed on the side surface of the second mounting support waterproof strip 230, the corresponding second mounting support waterproof strip groove 231 is matched with the second mounting support waterproof strip 230 in shape.

The second mounting support 210 includes second side plates 211 at two sides thereof, the upper end of each second side plate 211 extends inwardly to form a flat mounting plate 212, and the upper support 100 is in sealed connection with the flat mounting plate 212. That is, the bottom end of the first side plate 120 is in sealed connection with the flat mounting plate 212. The first side plate waterproof strip groove 131 is preferably provided at the bottom end of the side plate 120 or the upper surface of the flat mounting plate 212. The second mounting support waterproof strip groove 231 may be disposed at the bottom end of the second side plate 211.

In this embodiment, the light source base 220 includes a light source 221 and a heat dissipation assembly 222. The light source 221 is hermetically mounted on the upper surface of the heat dissipation assembly 222.

Figure 6:
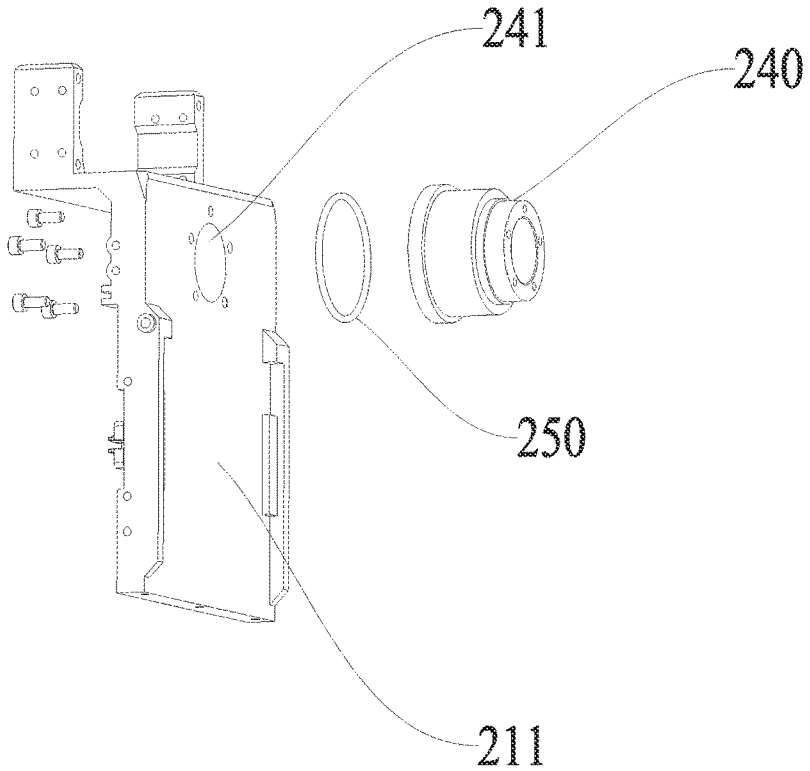
FIG. 6 is a structural schematic diagram of a second side plate and a pivot shaft in the invention.
Figure 7:
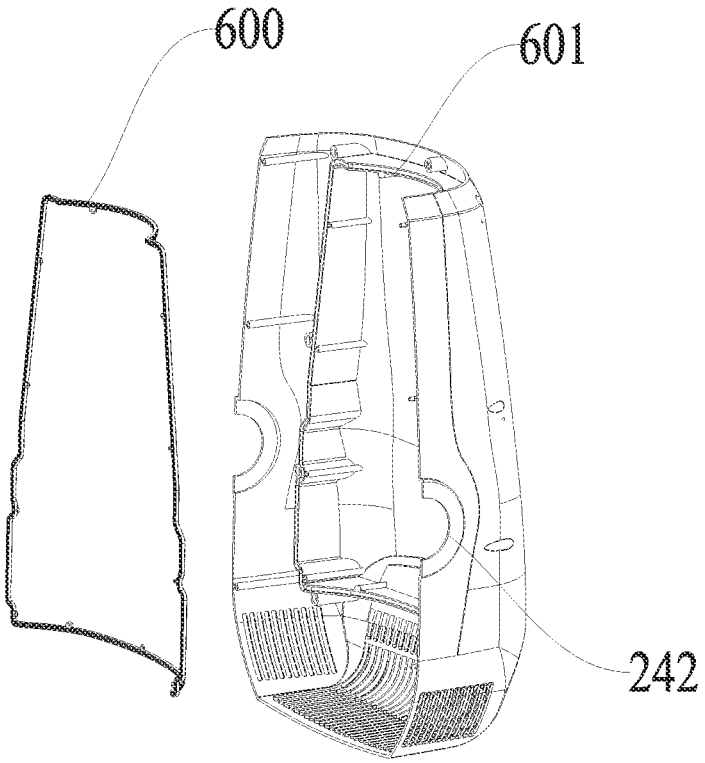
FIG. 7 is a structural schematic diagram of a main body waterproof strip groove and a main body waterproof strip on a rear cover in the present invention.

As shown in FIG. 3, pivot shafts 240 are respectively hermetically mounted at the left and right sides of the main bracket 1100, which are rotatably connected to an external U-shaped support 2000 for driving the whole light head to rotate. As shown in FIG. 6, each left and right sides of the main bracket 1100 is provided with a wire-passing hole 241. Corresponding to the wire-passing hole 240, the pivot shaft 240 is in sealed connection with the main bracket 1100. The wire-passing hole 241 facilitates passing wires of the elements between the U-shaped support 2000 and the interior of the light head structure. The pivot shaft 240 is in sealed connection with the main bracket 1100 through a pivot shaft waterproof strip 250. The pivot shaft waterproof strip 250 may be a ring-shaped waterproof strip with size thereof greater than that of the wire-passing hole 241, and the pivot shaft waterproof strip 250 is located between the outer edge of the pivot shaft 240 and the wire-passing hole 241. As shown in FIG. 7 and FIG. 8, the front cover 300 and the rear cover 400 are each provided with an arc-shaped groove 242 corresponding to the pivot shafts 240, so that when the front cover 300 and the rear cover 400 are joined, the arc-shaped grooves 242 of the front cover 300 and the rear cover 400 are engaged to form an avoidance hole for the pivot shaft 240.

When the lower support 200 is formed by the second mounting support 210 and the light source base 220, the pivot shafts 240 are mounted at the two sides of the second mounting support 210. The wire-passing holes 241 are correspondingly provided at the left and right sides of the second mounting support 210. The pivot shaft 240 is provided with a through hole for passing through the wires.

As shown in FIG. 7 and FIG. 8, the front cover 300 and the rear cover 400 are of a groove-shaped structure, and a main body waterproof strip groove 601 matched with the outer edges of the front and rear sides of the light outgoing lens assembly 500 and the front and rear sides of the main bracket 1100 is disposed in the groove-shaped structure. An integrated main body waterproof strip 600 in sealed connection with the outer edges of the front and rear sides of the light outgoing lens assembly 500 and the front and rear sides of the main bracket 1100 is disposed in the main body waterproof strip groove 601, and the shape of the integrated main body waterproof strip 600 is matched with the outer edges of the front and rear sides of a cavity structure formed by the light outgoing lens assembly 500 and the main bracket 1100.

Figure 10:
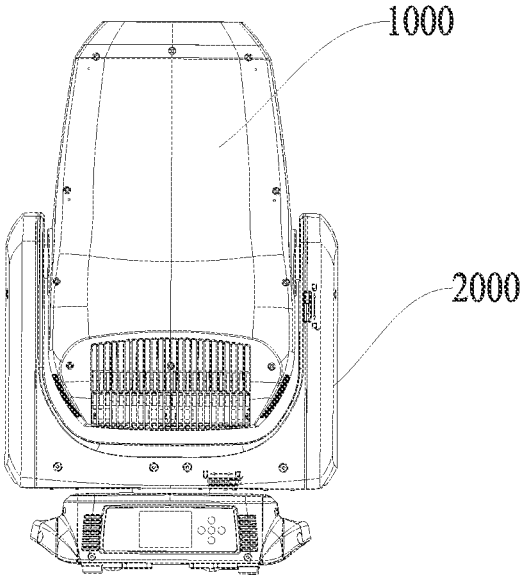
FIG. 10 is a diagram of a light containing the waterproof light head structure in the present invention.

FIG. 10 shows a stage light fixture including the waterproof light head structure 1000 and the U-shaped support 2000 mentioned above. The waterproof light head structure 1000 is rotatably connected to support arms at two sides of the U-shaped support 2000 through pivot shafts (not shown in the figure). The stage light fixture including the waterproof light head structure is easy to process, mount, maintain and use.

Obviously, the above-mentioned embodiments of the present invention are only examples for clearly illustrating the technical solutions of the present invention, rather than limiting the specific implementation modes of the present invention. Any modifications, equivalent replacements and improvements made within the spirit and principles of claims of the present invention shall be included within the protection scope of the claims of the present invention.

The invention claimed is:

1. A waterproof light head structure of a stage light fixture, comprising a main bracket, comprising an upper support which is at least used for mounting an optical lens assembly and a lower support which is at least used for mounting an effect assembly, the upper support being mounted above the lower support, and the upper support being in sealed and detachable connection with the lower support;

a front cover and a rear cover respectively disposed at a front side and a rear side of the main bracket; and a light outgoing lens assembly disposed above the main bracket, wherein the front cover and the rear cover are joined to form a cavity, the main bracket is disposed in the cavity, and the front cover and the rear cover are in sealed connection with the light outgoing lens assembly and the main bracket along edges thereof to form an all-around waterproof structure.

2. The waterproof light head structure according to claim 1, wherein the upper support comprises a first mounting support and first side plates respectively disposed at left and right sides of the first mounting support, and the first side plates are in sealed connection with the lower support.

3. The waterproof light head structure according to claim 2, wherein an upper end of each first side plate is respectively engaged with a left side and a right side of the light outgoing lens assembly to form sealed connection.

4. The waterproof light head structure according to claim 3, wherein the upper end of each first side plate is extended inwardly to form a U-shaped opening, and the U-shaped opening is respectively engaged with the left and right sides of the light outgoing lens assembly to form sealed connection.

5. The waterproof light head structure according to claim 2, wherein the first mounting support comprises a transversal beam and vertical plates at left and right sides of the transversal beam, each vertical plate is disposed at an inner side of the respective first side plate; an inner side of at least one vertical plate is provided with a sliding rail for guiding movement of the optical lens assembly; and/or an outer side of at least one vertical plate is provided with a drive circuit board.

6. The waterproof light head structure according to claim 1, wherein the light outgoing lens assembly comprises a lens module and a flange, the lens module is fixedly mounted at an upper end of the upper support via the flange, and the flange is in sealed connection with the upper end of the upper support.

7. The waterproof light head structure according to claim 1, wherein the lower support comprises a second mounting support and a light source base, the second mounting support is mounted above the light source base, and the second mounting support is in sealed connection with the light source base.

8. The waterproof light head structure according to claim 7, wherein a left side and a right side of the upper support are each provided with a first side plate, a left side and a right side of the second mounting support are each provided with a second side plate, and the second side plate is in sealed connection with the light source base; each of the front cover and the rear cover is in sealed connection with the light outgoing lens assembly, the first side plate, the second side plate, and the light source base.

9. The waterproof light head structure according to claim 1, wherein a pivot shaft is mounted at each of left and right sides of the main bracket in a sealed way, and the pivot shaft is rotatably connected to an external U-shaped support for driving the whole light head to rotate.

10. The waterproof light head structure according to claim 1, wherein each of the front cover and the rear cover is of a groove-shaped structure, and a main body waterproof strip groove matched with outer edges of front and rear sides of the light outgoing lens assembly and front and rear sides of the main bracket is provided in the respective groove-shaped structure.

11. The waterproof light head structure according to claim 10, wherein an integrated main body waterproof strip in sealed connection with the outer edges of the front and rear sides of the light outgoing lens assembly and the front and rear sides of the main bracket is provided in the main body waterproof strip groove, and a shape of the integrated main body waterproof strip is matched with outer edges of front and rear sides of a cavity formed by the lens module and the main bracket.

12. A stage light fixture, comprising the waterproof light head structure according to claim 1.

* * * * *